US007096977B2

(12) United States Patent
Juhasz et al.

(10) Patent No.: US 7,096,977 B2
(45) **Date of Patent: *Aug. 29, 2006**

(54) PIPE RUNNING TOOL

(75) Inventors: Daniel Juhasz, Westminster, CA (US); George Boyadjieff, Villa Park, CA (US); Brian L. Eidem, Cerritos, CA (US); Hans van Rijzingen, Oosterhout (NL); Herman Kamphorst, Assen (NL); Dieter Boettger, Den Helder (NL); Guus van Wechem, Reeuwijk (NL)

(73) Assignee: Varco I/P, Inc., Orange, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/040,453

(22) Filed: Jan. 20, 2005

(65) Prior Publication Data

US 2006/0005962 A1 Jan. 12, 2006

(51) Int. Cl.
*E21B 19/06* (2006.01)

(52) U.S. Cl. ..... 175/52; 175/85; 166/77.51

(58) Field of Classification Search ..... 175/52, 175/85, 162; 166/77.51, 77.52, 77.53, 85.1; 414/22.51

See application file for complete search history.

(56) References Cited

U.S. PATENT DOCUMENTS

| | | | |
|---|---|---|---|
| 3,193,116 | A | 7/1965 | Kenneday et al. |
| 3,706,347 | A | 12/1972 | Brown |
| 3,766,991 | A | 10/1973 | Brown |
| 3,780,883 | A | 12/1973 | Brown |
| 3,915,244 | A | 10/1975 | Brown |
| 4,274,778 | A | 6/1981 | Putnam et al. |
| 4,403,897 | A | 9/1983 | Willis |
| 4,449,596 | A | 5/1984 | Boyadjieff |
| 4,529,045 | A | 7/1985 | Boyadjieff et al. |
| 4,535,852 | A | 8/1985 | Boyadjieff et al. |
| 4,570,706 | A | 2/1986 | Pugnet |
| 4,605,077 | A | 8/1986 | Boyadjieff |
| 4,709,766 | A | 12/1987 | Boyadjieff |
| 4,781,359 | A | 11/1988 | Matus |
| 4,791,997 | A | 12/1988 | Krasnov |

(Continued)

FOREIGN PATENT DOCUMENTS

| | | | |
|---|---|---|---|
| EP | 0285385 | A2 | 10/1988 |

(Continued)

OTHER PUBLICATIONS

International Search Report relating to corresponding parent International Application No. PCT/US00/05752 dated Sep. 28, 2000.

(Continued)

*Primary Examiner*—William Neuder
(74) *Attorney, Agent, or Firm*—Christie, Parker & Hale, LLP

(57) ABSTRACT

A pipe running tool for use in an oil drilling system and the like comprises a lower drive shaft adapted to engage a drive shaft of a top drive assembly for rotation therewith. The pipe running tool further includes a lower pipe engagement assembly which is driven to rotate by the lower drive shaft, and is designed to releasably engage a pipe segment in such a manner to substantially prevent relative rotation between the two. Thus, when the lower pipe engagement assembly is actuated to securely hold a pipe segment, the top drive assembly may be actuated to rotate the top drive output shaft, which causes the lower drive shaft and lower pipe engagement assembly to rotate, which in turn rotates the pipe segment.

19 Claims, 4 Drawing Sheets

U.S. PATENT DOCUMENTS

| | | | | |
|---|---|---|---|---|
| 5,036,927 | A | 8/1991 | Willis | |
| 5,107,940 | A | 4/1992 | Berry | |
| 5,785,132 | A | 7/1998 | Richardson et al. | |
| 5,839,330 | A | 11/1998 | Stokka | |
| 6,142,545 | A | 11/2000 | Penman et al. | |
| 6,276,450 | B1 | 8/2001 | Seneviratne | |
| 6,443,241 | B1 | 9/2002 | Juhasz et al. | |
| 6,938,709 | B1 * | 9/2005 | Juhasz et al. | 175/52 |

FOREIGN PATENT DOCUMENTS

| | | |
|---|---|---|
| EP | 0311455 A1 | 4/1989 |
| EP | 0525247 | 2/1993 |
| WO | WO 92/11486 | 7/1992 |
| WO | WO 93/07358 | 4/1993 |
| WO | WO 96/18799 | 6/1996 |
| WO | WO 98/11322 | 3/1998 |
| WO | WO 99/30000 | 6/1999 |
| WO | WO 00/52297 | 9/2000 |

OTHER PUBLICATIONS

Kamphorst et al., Casing Running Tool; SPE/IADC 52770; pp. 1-9.

* cited by examiner

PIPE RUNNING TOOL

CROSS-REFERENCE TO RELATED APPLICATION(S)

This application is based on U.S. patent application Ser. No. 10/189,355, filed Jul. 3, 2002, which itself is based on U.S. patent application Ser. No. 09/518,122, filed Mar. 3, 2000, now U.S. Pat. No. 6,443,241, which claims priority to provisional patent application Ser. No. 60/122,915, filed Mar. 5, 1999, the disclosures of which are incorporated herein by reference.

BACKGROUND OF THE INVENTION

1. Field of the Invention

This invention relates to well drilling operations and, more particularly, to a device for assisting in the assembly of pipe strings, such as casing strings, drill strings and the like.

2. Description of the Related Art

The drilling of oil wells involves assembling drill strings and casing strings, each of which comprises a plurality of elongated, heavy pipe segments extending downwardly from an oil drilling rig into a hole. The drill string consists of a number of sections of pipe which are threadedly engaged together, with the lowest segment (i.e., the one extending the furthest into the hole) carrying a drill bit at its lower end. Typically, the casing string is provided around the drill string to line the well bore after drilling the hole and ensure the integrity of the hole. The casing string also consists of a plurality of pipe segments which are threadedly coupled together and formed with through passages sized to receive the drill string and/or other pipe strings.

The conventional manner in which plural casing segments are coupled together to form a casing string is a labor-intensive method involving the use of a "stabber" and casing tongs. The stabber is manually controlled to insert a segment of casing into the upper end of the existing casing string, and the tongs are designed to engage and rotate the segment to threadedly connect it to the casing string. While such a method is effective, it is cumbersome and relatively inefficient because the procedure is done manually. In addition, the casing tongs require a casing crew to properly engage the segment of casing and to couple the segment to the casing string. Thus, such a method is relatively labor-intensive and therefore costly. Furthermore, using casing tongs requires the setting up of scaffolding or other like structures, and is therefore inefficient.

Others have proposed a casing running tool for assembling casing strings which utilizes a conventional top drive assembly. The tool includes a pivotable manipulator which is designed to engage a pipe segment and raise the pipe segment up into a power assist spider, which relies on gravity to hold the pipe segment. The spider is coupled to the top drive and may be rotated by it. Thus, the pipe segment may be brought into contact with a casing string and the top drive activated to rotate the casing segment and threadedly engage it with the casing string.

While such a system provides benefits over the more conventional systems used to assemble casing strings, such a system suffers from shortcomings. One such shortcoming is that the casing segment may not be sufficiently engaged by the power assist spider to properly connect the casing segment with the casing string. In addition, the system fails to provide any means for effectively controlling the load applied to the threads at the bottom of the casing segment.

Without the ability to control the load on the threads, cross-threading may occur, resulting in stripped threads and a useless casing segment.

Accordingly, it will be apparent to those skilled in the art that there continues to be a need for a device for use in a drilling system which utilizes an existing top drive assembly to efficiently assemble casing and/or drill strings, and which positively engages a pipe segment to ensure proper coupling of the pipe segment to a pipe string. The present invention addresses these needs and others.

SUMMARY OF THE INVENTION

Briefly, and in general terms, the present invention is directed to a pipe running tool for use in drilling systems and the like to assemble casing and/or drill strings. The pipe running tool is coupled to an existing top drive assembly which is used to rotate a drill string, and includes a powered elevator that is powered into an engaged position to securely engage a pipe segment, for example, a casing segment. Because the elevator is powered into the engaged position, the pipe segment may be properly coupled to an existing pipe string using the top drive assembly.

The system of the present invention in one illustrative embodiment is directed to a pipe running tool mountable on a rig and including: a top drive assembly adapted to be connected to the rig for vertical displacement of the top drive assembly relative to the rig, the top drive assembly including a drive shaft, the top drive assembly being operative to rotate the drive shaft; and a lower pipe engagement assembly including a central passageway sized for receipt of the pipe segment, the lower pipe engagement assembly including a powered engagement device that is powered to an engaged position to securely and releasably grasp the pipe segment, the lower pipe engagement assembly being in communication with the drive shaft, whereby actuation of the top drive assembly causes the lower pipe engagement assembly to rotate.

In another illustrative embodiment, the present invention is directed to a method of assembling a pipe string, including the steps of: actuating a lower pipe engagement assembly to releasably engage a pipe segment; lowering a top drive assembly to bring the pipe segment into contact with a pipe string; monitoring the load on the pipe string; actuating a load compensator to raise the pipe segment a selected distance relative to the pipe string, if the load on the pipe string exceeds a predetermined threshold value; and actuating the top drive assembly to rotate the pipe segment to threadedly engage the pipe segment and pipe string.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENTS

Figure 1:
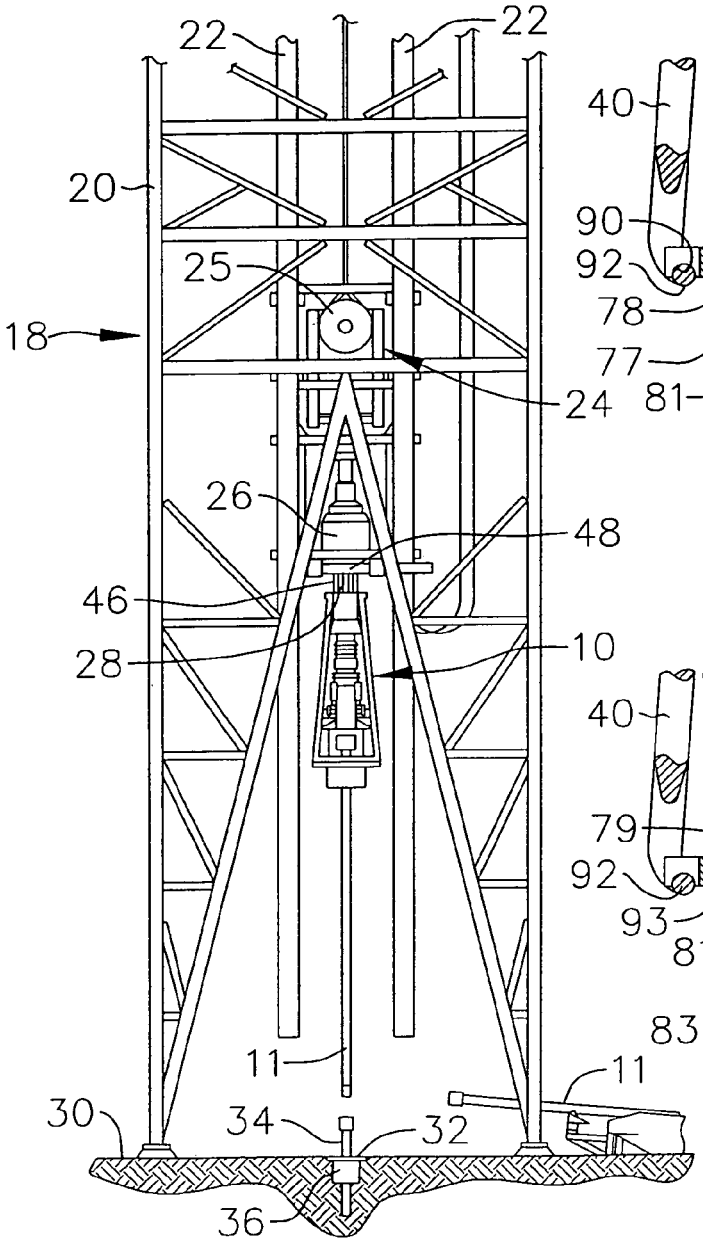
FIG. 1 is an elevated side view of a drilling rig incorporating a pipe running tool according to one illustrative embodiment of the present invention.
Figure 2:
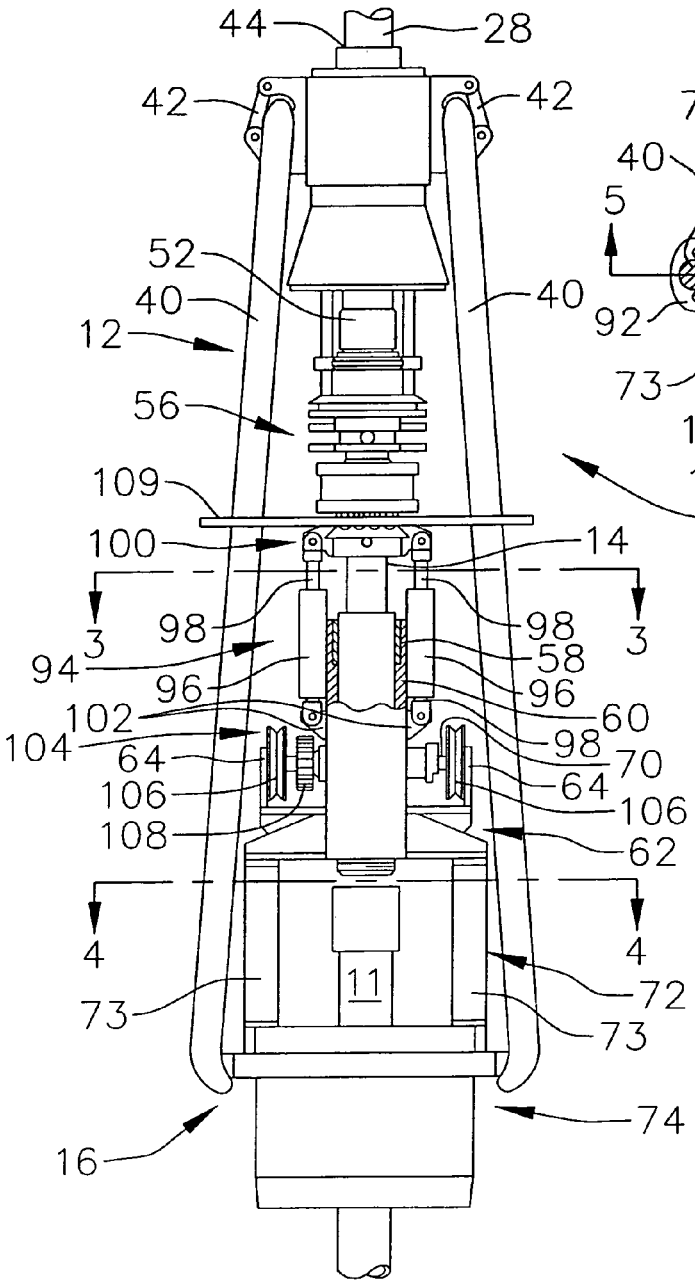
FIG. 2 is a side view, in enlarged scale, of the pipe running tool of FIG. 1.
Figure 4:
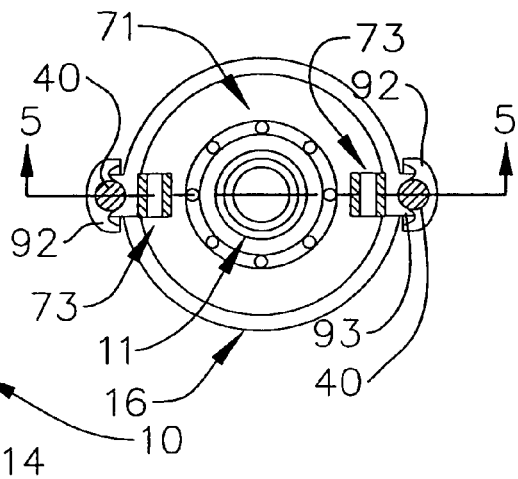
FIG. 4 is a cross-sectional view taken along the line 4—4 of FIG. 2.
Figure 3:
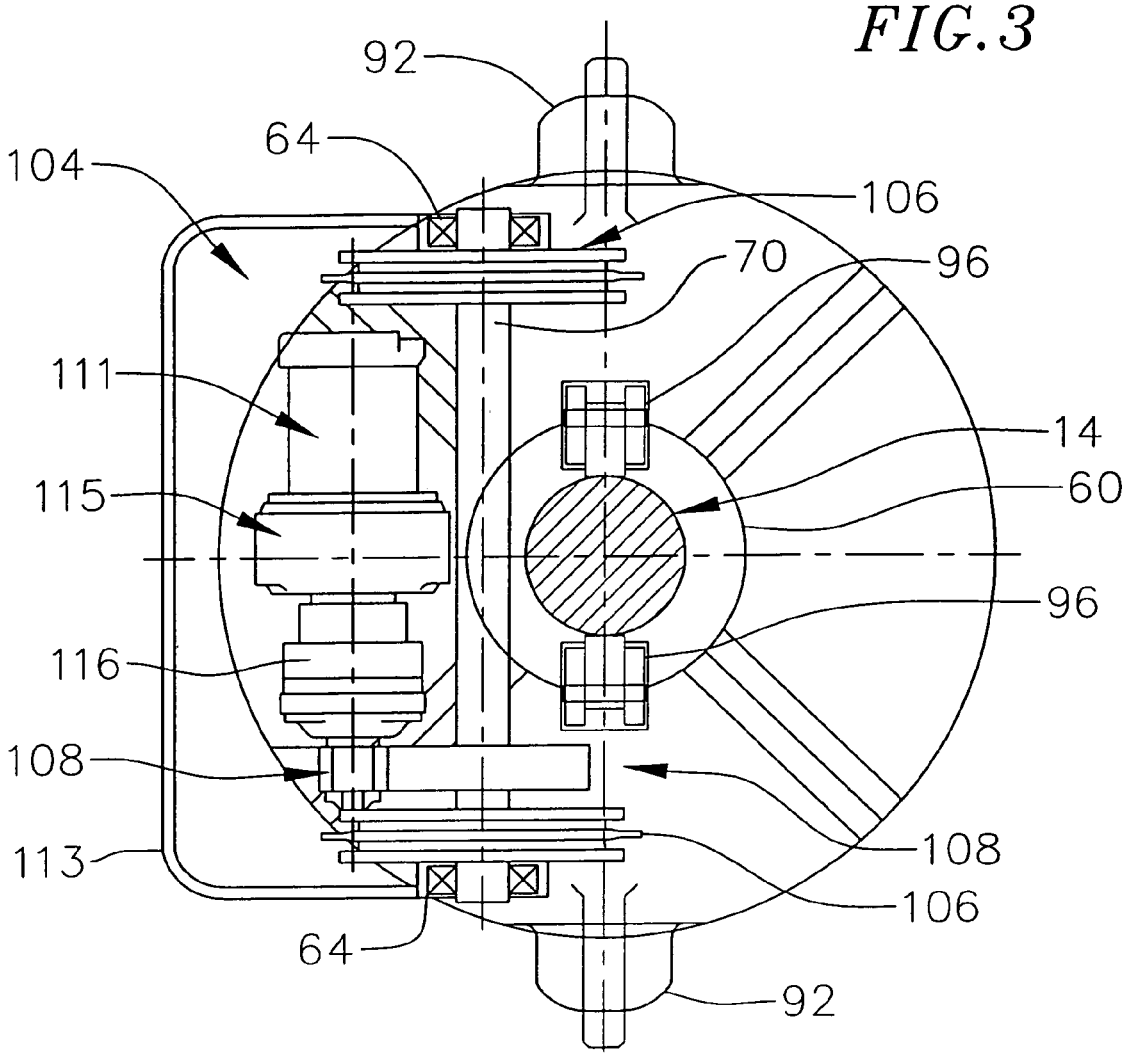
FIG. 3 is a cross-sectional view taken along the line 3—3 of FIG. 2.

In the following detailed description, like reference numerals will be used to refer to like or corresponding elements in the different figures of the drawings. Referring now to FIGS. 1 and 2, there is shown a pipe running tool 10 depicting one illustrative embodiment of the present invention, which is designed for use in assembling pipe strings, such as drill strings, casing strings, and the like. The pipe running tool 10 comprises, generally, a frame assembly 12, a rotatable shaft 14, and a lower pipe engagement assembly 16 that is coupled to the rotatable shaft for rotation therewith. The pipe engagement assembly is designed for selective engagement of a pipe segment 11 (FIGS. 1, 2, and 5A) to substantially prevent relative rotation between the pipe segment and the pipe engagement assembly. The rotatable shaft 14 is designed for coupling with a top drive output shaft from an existing top drive, such that the top drive, which is normally used to rotate a drill string to drill a well hole, may be used to assemble a pipe string, for example, a casing string or a drill string, as is described in greater detail below.

The pipe running tool 10 is designed for use, for example, in a well drilling rig 18. A suitable example of such a rig is disclosed in U.S. Pat. No. 4,765,401 to Boyadjieff, which is expressly incorporated herein by reference as if fully set forth herein. As shown in FIG. 1, the rig includes a frame 20 and a pair of guide rails 22 along which a top drive assembly, generally designated 24, may ride for vertical movement relative to the rig. The top drive assembly is preferably a conventional top drive used to rotate a drill string to drill a well hole, as is described in U.S. Pat. No. 4,605,077 to Boyadjieff, which is expressly incorporated herein by reference. The top drive assembly includes a drive motor 26 and a top drive output shaft 28 extending downwardly from the drive motor, with the drive motor being operative to rotate the drive shaft, as is conventional in the art. The rig defines a drill floor 30 having a central opening 32 through which a drill string and/or casing string 34 is extended downwardly into a well hole.

The rig 18 also includes a flush-mounted spider 36 that is configured to releasably engage the drill string and/or casing string 34 and support the weight thereof as it extends downwardly from the spider into the well hole. As is well known in the art, the spider includes a generally cylindrical housing which defines a central passageway through which the pipe string may pass. The spider includes a plurality of slips which are located within the housing and are selectively displaceable between disengaged and engaged positions, with the slips being driven radially inwardly to the respective engaged positions to tightly engage the pipe segment and thereby prevent relative movement or rotation of the pipe segment and the spider housing. The slips are preferably driven between the disengaged and engaged positions by means of a hydraulic or pneumatic system, but may be driven by any other suitable means.

Referring primarily to FIG. 2, the pipe running tool 10 includes the frame assembly 12, which comprises a pair of links 40 extending downwardly from a link adapter 42. The link adapter defines a central opening 44 through which the top drive output shaft 28 may pass. Mounted to the link adapter on diametrically opposed sides of the central opening are respective upwardly extending, tubular members 46 (FIG. 1), which are spaced a predetermined distance apart to allow the top drive output shaft 28 to pass therebetween. The respective tubular members connect at their upper ends to a rotating head 48, which is connected to the top drive assembly 24 for movement therewith. The rotating head defines a central opening (not shown) through which the top drive output shaft may pass, and also includes a bearing (not shown) which engages the upper ends of the tubular members and permits the tubular members to rotate relative to the rotating head body, as is described in greater detail below.

The top drive output shaft 28 terminates at its lower end in an internally splined coupler 52 which is engaged to an upper end of the lower drive shaft 14 (not shown) which is formed to complement the splined coupler for rotation therewith. Thus, when the top drive output shaft 28 is rotated by the top drive motor 26, the lower drive shaft 14 is also rotated. It will be understood that any suitable interface may be used to securely engage the top and lower drive shafts together.

In one illustrative embodiment, the lower drive shaft 14 is connected to a conventional pipe handler, generally designated 56, which may be engaged by a suitable torque wrench (not shown) to rotate the lower drive shaft and thereby make and break connections that require very high torque, as is well known in the art.

The lower drive shaft 14 is also formed with a splined segment 58, which is slidably received in an elongated, splined bushing 60 which serves as an extension of the lower drive shaft. The drive shaft and bushing are splined to provide for vertical movement of the shaft relative to the bushing, as is described in greater detail below. It will be understood that the splined interface causes the bushing to rotate when the lower drive shaft rotates.

The pipe running tool 10 further includes the lower pipe engagement assembly 16, which in one embodiment comprises a torque transfer sleeve 62 which is securely connected to the lower end of the bushing 60 for rotation therewith. The torque transfer sleeve is generally annular and includes a pair of upwardly projecting arms 64 on diametrically opposed sides of the sleeve. The arms are formed with respective horizontal through passageways (not shown) into which are mounted respective bearings (not shown) which serve to journal a rotatable axle 70 therein, as described in greater detail below. The transfer sleeve connects at its lower end to a downwardly extending torque frame 72 in the form of a pair of tubular members 73, which in turn is coupled to a spider\elevator 74 which rotates with the torque frame. It will be apparent that the torque frame may take many, such as a plurality of tubular members, a solid body, or any other suitable structure.

Figure 5A:
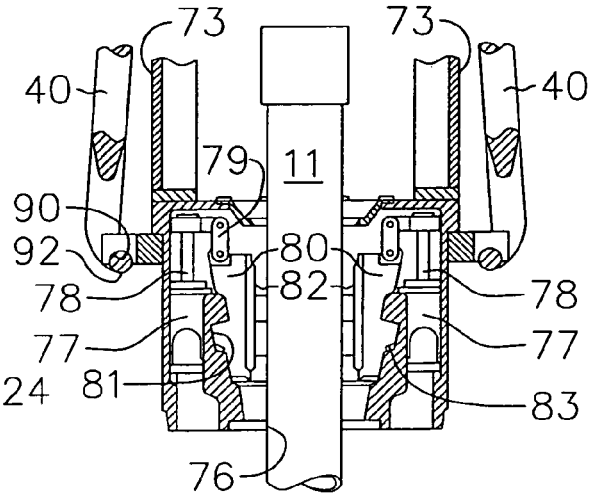
FIG. 5A is a cross-sectional view taken along the line 5—5 of FIG. 4 and showing a spider\elevator in a disengaged position.
Figure 5B:
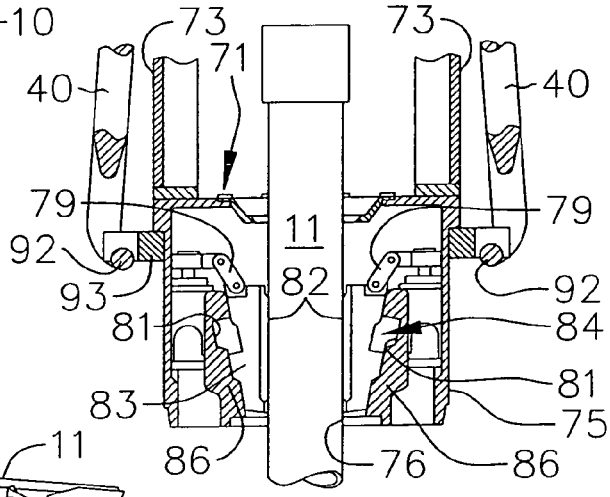
FIG. 5B is a cross-sectional view similar to FIG. 5A and showing the spider\elevator in an engaged position.

The spider\elevator 74 is preferably powered by a hydraulic or pneumatic system, or alternatively by an electric drive motor or any other suitable powered system. In the embodiment disclosed, the spider\elevator includes a housing 75 which defines a central passageway 76 through which the pipe segment 11 may pass. The spider\elevator also includes a pair of hydraulic or pneumatic cylinders 77 with displaceable piston rods 78 (FIGS. 5A and 5B) which are connected through suitable pivotable linkages 79 to respective slips 80. The linkages are pivotally connected to both the top ends of the piston rods and to the top ends of the slips. The slips include generally planar front gripping surfaces 82, and specially contoured rear surfaces 84 which are designed with such a contour to cause the slips to travel between respective radially outwardly disposed, disengaged positions, and radially inwardly disposed, engaged positions. The rear surfaces of the slips travel along respective downwardly and radially inwardly projecting guiding members 86 which are complementarily contoured and securely connected to the spider body. The guiding members cooperate with the cylinders and linkages to cam the slips radially inwardly and force the slips into the respective engaged positions. Thus, the cylinders (or other actuating means) may be empowered to drive the piston rods downwardly, causing the corresponding linkages to be driven downwardly and therefore force the slips downwardly. The surfaces of the guiding members are angled to force the slips radially inwardly as they are driven downwardly to sandwich the pipe segment 11 between them, with the guiding members maintaining the slips in tight engagement with the pipe segment. To release the pipe segment 11, the cylinders 76 are operated in reverse to drive the piston rods upwardly, which draws the linkages upwardly and retracts the respective slips back to their disengaged positions to release the pipe segment. The guiding members are preferably formed with respective notches 81 which receive respective projecting portions 83 of the slips to lock the slips in the disengaged position (FIG. 5A).

The spider\elevator 74 further includes a pair of diametrically opposed, outwardly projecting ears 88 formed with downwardly facing recesses 90 sized to receive correspondingly formed, cylindrical members 92 at the bottom ends of the respective links 40, and thereby securely connect the lower ends of the links to the spider\elevator. The ears may be connected to an annular sleeve 93 which is received over the housing 75, or may be formed integral with the housing.

In one illustrative embodiment, the pipe running tool 10 includes a load compensator, generally designated 94. The load compensator preferably is in the form of a pair of hydraulic, double rodded cylinders 96, each of which includes a pair of piston rods 98 that are selectively extendable from, and retractable into, the cylinder. The upper rods connect to a compensator clamp 100, which in turn is connected to the lower drive shaft 14, while the lower rods extend downwardly and connect at the respective lower ends to a pair of ears 102 which are securely mounted to the bushing 60. The hydraulic cylinders may be actuated to draw the bushing upwardly relative to the lower drive shaft 14 by applying a pressure to the cylinders which causes the upper piston rods to retract into the respective cylinder bodies, with the splined interface between the bushing and lower drive shaft allowing the bushing to be displaced vertically relative to the shaft. In that manner, the pipe segment 11 carried by the spider\elevator 74 may be raised vertically to relieve a portion or all of the load applied to the pipe segment 11, as is described in greater detail below. As is shown in FIG. 2, the lower rods are at least partially retracted, resulting in the majority of the load from the pipe running tool 10 is assumed by the top drive output shaft 28. In addition, when a load above a preselected maximum is applied to the pipe segment 11, the cylinders 96 will automatically react the load to prevent the entire load from being applied to the threads of the pipe segment.

The pipe running tool 10 still further includes a hoist mechanism, generally designated 104, for hoisting a pipe segment upwardly into the spider\elevator 74. The hoist mechanism is disposed off-axis and includes a pair of pulleys 106 carried by the axle 70, the axle being journaled into the bearings in respective through passageways formed in the arms 64. The hoist mechanism also includes a gear drive, generally designated 108, that may be selectively driven by a hydraulic motor 111 or other suitable drive system to rotate the axle and thus the pulleys. The hoist may also include a brake 115 to prevent rotation of the axle and therefore of the pulleys and lock them in place, as well as a torque hub 116. Therefore, a pair of chains, cables, or other suitable, flexible means may be run over the respective pulleys, extended through a chain well 113, and engaged to the pipe segment 11, and the axle is then rotated by a suitable drive system to hoist the pipe segment vertically and up into position with the upper end of the pipe segment 11 extending into the spider\elevator 74.

The pipe running tool 10 preferably further includes an annular collar 109 which is received over the links 40 and which maintains the links locked to the ears 88 and prevents the links from twisting and/or winding.

In use, a work crew may manipulate the pipe running tool 10 until the upper end of the tool is aligned with the lower end of the top drive output shaft 28. The pipe running tool 10 is then raised vertically until the splined coupler 52 at the lower end of the top drive output shaft is engaged to the upper end of the lower drive shaft 14 and the links 40 are engaged with the ears 93. The work crew may then run a pair of chains or cables over the respective pulleys 106 of the hoist mechanism 104, connect the chains or cables to a pipe segment 1 1, engage a suitable drive system to the gear 108, and actuate the drive system to rotate the pulleys and thereby hoist the pipe segment upwardly until the upper end of the pipe segment extends through the lower end of the spider\elevator 74. The spider\elevator is then actuated, with the hydraulic cylinders 77 and guiding members 86 cooperating to forcibly drive the respective slips 84 into the engaged positions (FIG. 5B) to positively engage the pipe segment. The slips are preferably advanced to a sufficient extent to prevent relative rotation between the pipe segment and the spider\elevator, such that rotation of the spider\elevator translates into rotation of the pipe segment.

The top drive assembly 24 is then lowered relative to the frame 20 by means of the top hoist 25 to drive the threaded lower end of the pipe segment 11 into contact with the threaded upper end of the pipe string 34 (FIG. 1). As shown in FIG. 1, the pipe string is securely held in place by means of the flush-mounted spider 36 or any other suitable structure for securing the string in place, as is well known to those skilled in the art. Once the threads are properly mated, the top drive motor 26 is then actuated to rotate the top drive output shaft, which in turn rotates the lower drive shaft of the pipe running tool 10 and the spider\elevator 74, which causes the coupled pipe segment to rotate and thereby be threadedly engaged to the pipe string.

In one embodiment, the pipe segment 11 is intentionally lowered until the lower end of the pipe segment rests on the top of the pipe string 34. The load compensator 94 is then actuated to drive the bushing 60 upwardly relative to the lower drive shaft 14 via the splined interface between the two. The upward movement of the bushing causes the spider\elevator 74 and therefore the coupled pipe segment 11 to be raised, thereby reducing the weight on the threads of the pipe segment. In this manner, the load on the threads can be controlled by actuating the load compensator.

Once the pipe segment 11 is threadedly coupled to the pipe string, the top drive assembly 24 is raised vertically to lift the entire pipe string 34, which causes the flush-mounted spider 36 to disengage the string. The top drive assembly 24 is then lowered to advance the string downwardly into the well hole until the upper end of the top pipe segment 11 is close to the drill floor 30, with the entire load of the pipe string being carried by the links 40 while the torque was supplied through shafts. The flush-mounted spider 36 is then actuated to engage the pipe string and suspend it therefrom. The spider\elevator 74 is then controlled in reverse to retract the slips 84 back to the respective disengaged positions (FIG. 5A) to release the pipe string. The top drive assembly 24 is then raised to lift the pipe running tool 10 up to a starting position (such as that shown in FIG. 1) and the process may be repeated with an additional pipe segment 11.

Figure 6:
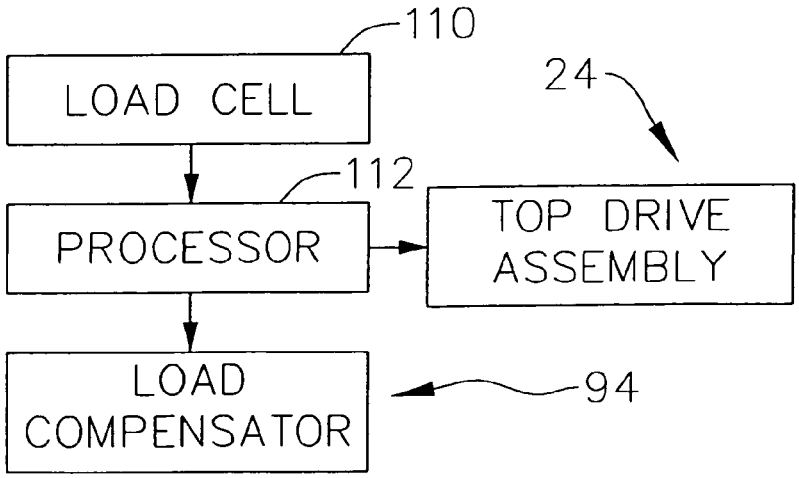
FIG. 6 is a block diagram of components included in one illustrative embodiment of the invention.

Referring to FIG. 6, there is shown a block diagram of components included in one illustrative embodiment of the pipe running tool 10. In this embodiment, the tool includes a conventional load cell 110 or other suitable load-measuring device mounted on the pipe running tool 10 in such a manner that it is in communication with the lower drive shaft 14 to determine the load applied to the lower end of the pipe segment 11. The load cell is operative to generate a signal representing the load sensed, which in one illustrative embodiment is transmitted to a processor 112. The processor is programmed with a predetermined threshold load value, and compares the signal from the load cell with that value. If the load exceeds the value, the processor then controls the load compensator 94 to draw upwardly a selected amount to relieve at least a portion of the load on the threads of the pipe segment. Once the load is at or below the threshold value, the processor controls the top drive assembly 24 to rotate the pipe segment 11 and thereby threadedly engage the pipe segment to the pipe string 34. While the top drive assembly is actuated, the processor continues to monitor the signals from the load cell to ensure that the load on the pipe segment does not exceed the threshold value.

Alternatively, the load on the pipe segment 11 may be controlled manually, with the load cell 110 indicating the load on the pipe segment via a suitable gauge or other display, with a work person controlling the load compensator 94 and top drive assembly 24 accordingly.

Figure 7:
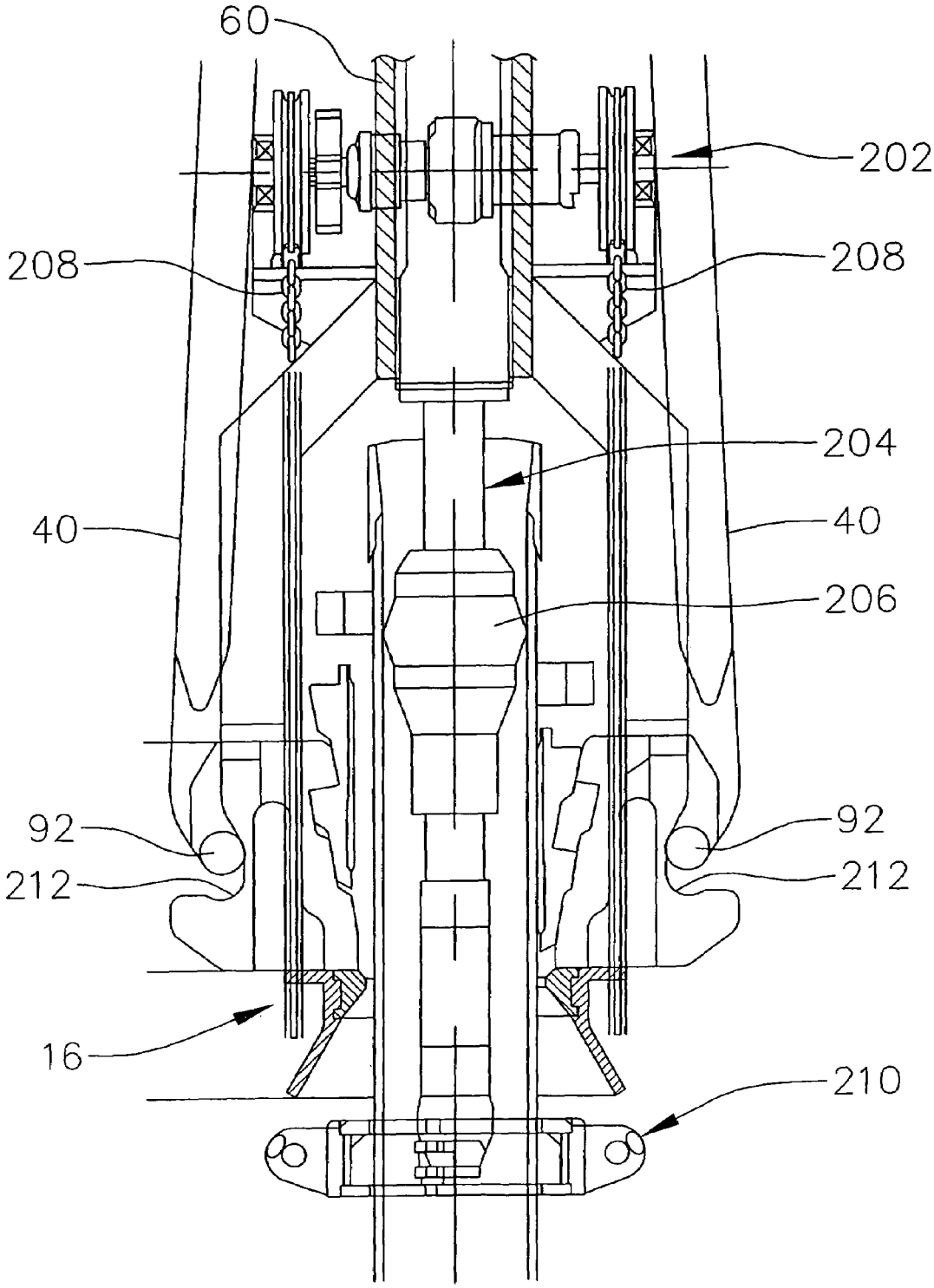
FIG. 7 is a side view of another illustrative embodiment of the invention.

Referring to FIG. 7, there is shown another preferred embodiment of the pipe running tool 200 of the present invention. The pipe running tool includes a hoisting mechanism 202 which is substantially the same as the hoisting mechanism 104 described above. A lower drive shaft 204 is provided and connects at its lower end to a conventional mud-filling device 206 which, as is known in the art, is used to fill a pipe segment, for example, a casing segment, with mud during the assembly process. In one illustrative embodiment, the mud-filling device is a device manufactured by Davies-Lynch Inc. of Texas.

The hoisting mechanism 202 supports a pair of chains 208 which engage a slip-type single joint elevator 210 at the lower end of the pipe running tool 200. As is known in the art, the single joint elevator is operative to releasably engage a pipe segment 11, with the hoisting mechanism 202 being operative to raise the single joint elevator and pipe segment upwardly and into the spider\elevator 74.

The tool 200 includes the links 40 which define the cylindrical lower ends 92 which are received in generally J-shaped cut-outs 212 formed in diametrically opposite sides of the spider\elevator 74.

From the foregoing, it will be apparent that the pipe running tool 10 efficiently utilizes an existing top drive assembly to assemble a pipe string, for example, a casing or drill string, and does not rely on cumbersome casing tongs and other conventional devices. The pipe running tool incorporates the spider\elevator 74, which not only carries pipe segments, but also imparts rotation to them to threadedly engage the pipe segments to an existing pipe string. Thus, the pipe running tool provides a device which grips and torques the pipe segment 11, and which also is capable of supporting the entire load of the pipe string as it is lowered down into the well hole.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A pipe running tool mountable on a rig for use in introducing pipe into a borehole, handling pipe segments and for engaging the pipe segments to a string of pipe, the pipe running tool comprising:

a top drive assembly adapted to be connected to the rig for vertical displacement of the top drive assembly relative to the rig, the top drive assembly including a drive shaft, the top drive assembly being operative to rotate the drive shaft; and a lower pipe engagement assembly including a powered pipe engaging mechanism that is selectively driven into a pipe engagement position to forcibly yet releasably engage the pipe segment to support at least a portion of the weight of the string of pipe and to substantially prevent relative rotation therebetween, the lower pipe engagement assembly being in communication with the drive shaft, whereby actuation of the top drive assembly causes the lower pipe engagement assembly to rotate, such that the powered engaging mechanism imparts vertical and rotational motion of the top drive assembly to the pipe segment during operation.

2. The pipe running tool of claim 1, further including a hoist mechanism connected to the lower pipe engagement assembly and operative to hoist a pipe segment into engagement with the lower pipe engagement assembly.

3. The pipe running tool of claim 2, wherein the hoist mechanism comprises an axle journaled to the lower pipe engagement member, a pair of pulleys rotatably mounted to the axle, and a gear connected to the axle, whereby the gear may be coupled to a drive system for rotating the axle.

4. The pipe running tool of claim 1, wherein the lower pipe engagement assembly comprises a powered elevator.

5. The pipe running tool of claim 4, wherein the powered elevator is powered by one of a hydraulic system and a pneumatic system.

6. The pipe running tool of claim 5, wherein the powered elevator comprises a plurality of slips displaceable radially to engage a casing segment.

7. The pipe running tool of claim 1, further including a block connected to the top drive assembly and adapted for engaging a plurality of cables connected to the rig.

8. The pipe running tool of claim 6, wherein the powered elevator is designed to grip an external surface of the pipe segment.

9. A pipe running tool mountable on a rig for use in introducing pipe into a borehole, handling pipe segments and for engaging the pipe segments to a string of pipe, the pipe running tool comprising:

a top drive assembly adapted to be connected to the rig for vertical displacement of the top drive assembly relative to the rig, the top drive assembly including a drive shaft, the top drive assembly being operative to rotate the drive shaft;

a lower drive shaft coupled to the top drive output shaft and comprising an adjustable segment that is selectively adjustable to adjust the length of the lower drive shaft;

a lower pipe engagement assembly being operative to releasably grasp the pipe segment, the lower pipe engagement assembly being connected to the second drive shaft, whereby actuation of the top drive assembly causes the lower pipe engagement assembly to rotate; and means for applying a force to the lower drive shaft to cause the length of the adjustable segment to be shortened.

10. The pipe running tool of claim 9, wherein the means for applying a force comprises a load compensator in the form of a pair of hydraulic cylinders.

11. The pipe running tool of claim 9, wherein the lower pipe engagement assembly comprises a powered elevator.

12. the pipe running tool of claim 11, wherein the powered elevator comprises a plurality of slips displaceable radially to engage a casing segment.

13. The pipe running tool of claim 9, further including a block connected to the top drive assembly and adapted for engaging a plurality of cables connected to the rig to selectively raise and lower the top drive assembly.

14. A pipe running tool mountable on a rig and designed for use in connection with a top drive assembly adapted to be connected to the rig for vertical displacement of the top drive assembly relative to the rig, the top drive assembly including a drive shaft, the top drive assembly being operative to rotate the drive shaft, the pipe running tool comprising:

a lower pipe engagement assembly comprising:

a powered elevator coupled to the top drive assembly for rotation therewith having a plurality of slips sized for engagement with a pipe segment, and displaceable between disengaged and engaged positions; and a powered system connected to the respective slips and operative to selectively drive the slips between the disengaged and engaged position to support at least a portion of the weight of the string of pipe and to substantially prevent relative rotation therebetween.

15. The pipe running tool of claim 14, further including a hoist mechanism connected to the lower pipe engagement assembly and operative to hoist a pipe segment into engagement with the lower pipe engagement assembly.

16. The pipe running tool of claim 15, wherein the hoist mechanism comprises an axle journaled to the lower pipe engagement member, a pair of pulleys rotatably mounted to the axle, and a gear connected to the axle, whereby the gear may be coupled to a drive system for rotating the axle.

17. The pipe running tool of claim 14, wherein the powered system comprises one of a hydraulic and pneumatic system.

18. The pipe running tool of claim 14, further including a block connected to the top drive assembly and adapted for engaging a plurality of cables connected to the rig.

19. The pipe running tool of claim 14, wherein the powered elevator is designed to grip the external surface of the pipe segment.

* * * * *

US007096977C1

(12) INTER PARTES REEXAMINATION CERTIFICATE (0390th)

United States Patent
Juhasz et al.

(10) Number: US 7,096,977 C1
(45) **Certificate Issued: *Jun. 19, 2012**

(54) PIPE RUNNING TOOL

(75) Inventors: Daniel Juhasz, Westminster, CA (US); George Boyadjieff, Villa Park, CA (US); Brian L. Eidem, Cerritos, CA (US); Hans van Rijzingen, Oosterhout (NL); Herman Kamphorst, Assen (NL); Dieter Boettger, Den Helder (NL); Guus van Wechem, Reeuwijk (NL)

(73) Assignee: Varco I/P, Inc., Orange, CA (US)

Reexamination Request:
No. 95/000,162, Oct. 17, 2006

Reexamination Certificate for:

| | |
|---|---|
| Patent No.: | **7,096,977** |
| Issued: | **Aug. 29, 2006** |
| Appl. No.: | **11/040,453** |
| Filed: | **Jan. 20, 2005** |

( * ) Notice: This patent is subject to a terminal disclaimer.

Certificate of Correction issued Aug. 29, 2006.

Related U.S. Application Data

(63) Continuation of application No. 10/189,355, filed on Jul. 3, 2002, now Pat. No. 6,938,709, which is a continuation of application No. 09/518,122, filed on Mar. 3, 2000, now Pat. No. 6,443,241.

(60) Provisional application No. 60/122,915, filed on Mar. 5, 1999.

(51) Int. Cl.
*E21B 19/06* (2006.01)

(52) U.S. Cl. ..... 175/52; 175/85; 166/77.51

(58) Field of Classification Search ..... 166/77.51; 175/52, 85
See application file for complete search history.

(56) References Cited

To view the complete listing of prior art documents cited during the proceeding for Reexamination Control Number 95/000,162, please refer to the USPTO's public Patent Application Information Retrieval (PAIR) system under the Display References tab.

*Primary Examiner*—Jimmy G Foster

(57) ABSTRACT

A pipe running tool for use in an oil drilling system and the like comprises a lower drive shaft adapted to engage a drive shaft of a top drive assembly for rotation therewith. The pipe running tool further includes a lower pipe engagement assembly which is driven to rotate by the lower drive shaft, and is designed to releasably engage a pipe segment in such a manner to substantially prevent relative rotation between the two. Thus, when the lower pipe engagement assembly is actuated to securely hold a pipe segment, the top drive assembly may be actuated to rotate the top drive output shaft, which causes the lower drive shaft and lower pipe engagement assembly to rotate, which in turn rotates the pipe segment.

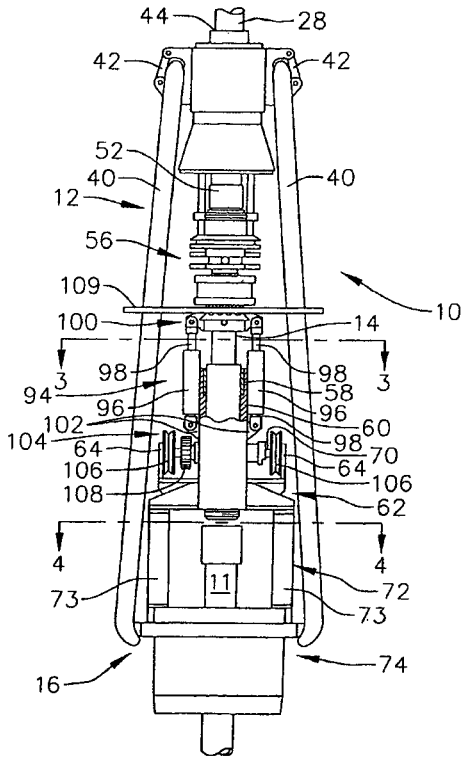

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-19 are cancelled.

* * * * *